US009309888B2

(12) United States Patent
Ginies et al.

(10) Patent No.: US 9,309,888 B2
(45) **Date of Patent: *Apr. 12, 2016**

(54) VALVE ARRANGEMENT FOR A SCROLL REFRIGERATION COMPRESSOR

(75) Inventors: Pierre Ginies, Sathonay Village (FR); Christophe Ancel, Villefranche sur Saone (FR)

(73) Assignee: DANFOSS COMMERCIAL COMPRESSORS, Trevoux (FR)

( * ) Notice: Subject to any disclaimer, the term of this patent is extended or adjusted under 35 U.S.C. 154(b) by 281 days.

This patent is subject to a terminal disclaimer.

(21) Appl. No.: 13/701,407

(22) PCT Filed: May 16, 2011

(86) PCT No.: PCT/FR2011/051084
§ 371 (c)(1),
(2), (4) Date: Nov. 30, 2012

(87) PCT Pub. No.: WO2011/151553

PCT Pub. Date: Dec. 8, 2011

(65) Prior Publication Data

US 2013/0071276 A1 Mar. 21, 2013

(30) Foreign Application Priority Data

Jun. 2, 2010 (FR) ..... 10 54287

(51) Int. Cl.
*F01C 1/063* (2006.01)
*F01C 1/02* (2006.01)
(Continued)

(52) U.S. Cl.
CPC ..... *F04C 29/00* (2013.01); *F04C 28/16* (2013.01); *F04C 29/128* (2013.01); *F04C 18/0215* (2013.01); *F04C 18/0246* (2013.01)

(58) Field of Classification Search
CPC ..... F04C 28/16; F04C 29/00; F04C 29/128
USPC ..... 418/55.1–55.6, 57, 270; 137/855, 852, 137/454.4, 512, 512.2, 512.3, 513
See application file for complete search history.

(56) References Cited

U.S. PATENT DOCUMENTS 2,858,162 A * 10/1958 Frank ..... 239/129
5,674,058 A 10/1997 Matsuda et al.
(Continued)

FOREIGN PATENT DOCUMENTS

CN 1196776 A 10/1998
DE 36 32 318 A1 3/1988
(Continued)

OTHER PUBLICATIONS

Korean Patent Publication 2006074489 to Kim et al, Machine Translation by K-PIO, Jul. 3, 2006.*
(Continued)

*Primary Examiner* — Jorge Pereiro
*Assistant Examiner* — Deming Wan
(74) *Attorney, Agent, or Firm* — Oliff PLC

(57) ABSTRACT

A valve arrangement including a valve plate with at least one delivery port intended to allow fluid flow from a delivery line made in of a volute of the compressor, and a valve seat made on a first face of the valve plate, a delivery valve moveable between an obturation position and a release position, retaining means arranged for limiting the movement range of the delivery valve. The arrangement further includes at least one bypass valve positioned adjacent to the second face of the valve plate, the bypass valve being moveable between an obturation position of a bypass channel made in the plate of said volute, and a release position in of said bypass channel, and retaining means positioned on the second face of the valve plate and arranged in order to limit the movement range of the bypass valve towards its release position.

10 Claims, 6 Drawing Sheets

(51) Int. Cl.

| | |
|---|---|
| ***F04B 49/03*** | (2006.01) |
| ***F16K 15/14*** | (2006.01) |
| ***F16K 15/08*** | (2006.01) |
| ***F04C 29/00*** | (2006.01) |
| ***F04C 28/16*** | (2006.01) |
| ***F04C 29/12*** | (2006.01) |
| *F04C 18/02* | (2006.01) |

(56) References Cited

U.S. PATENT DOCUMENTS

| | | | | |
|---|---|---|---|---|
| 5,855,475 | A | 1/1999 | Fujio et al. | |
| 6,095,764 | A | 8/2000 | Shibamoto et al. | |
| 6,164,940 | A | 12/2000 | Terauchi et al. | |
| 6,190,138 | B1 | 2/2001 | Hugenroth et al. | |
| 6,419,457 | B1 * | 7/2002 | Seibel et al. | 417/213 |
| 2003/0190247 | A1 | 10/2003 | Tsubono et al. | |
| 2005/0135939 | A1 | 6/2005 | Kim | |
| 2006/0099098 | A1 | 5/2006 | Lee et al. | |
| 2010/0028183 | A1 | 2/2010 | Sun | |

FOREIGN PATENT DOCUMENTS

| | | | |
|---|---|---|---|
| EP | 1039136 | A2 | 9/2000 |
| EP | 1 519 047 | A1 | 3/2005 |
| JP | S60228788 | A | 11/1985 |
| JP | S6229784 | A | 2/1987 |
| WO | 99/45274 | A1 | 9/1999 |

OTHER PUBLICATIONS

International Search Report issued in Application No. PCT/FR2011/051084; Dated Sep. 21, 2012 (With Translation).

Jan. 19, 2011 French Preliminary Search Report issued in Application No. 1054288.

* cited by examiner

VALVE ARRANGEMENT FOR A SCROLL REFRIGERATION COMPRESSOR

The present invention relates to a valve arrangement for a scroll refrigeration compressor and to a compressor comprising such an arrangement.

In a known way, a scroll refrigeration compressor comprises a first stationary volute and a second volute describing an orbital movement, each volute including a plate on which extends a scroll, both scrolls being engaged into each other and delimiting compression chambers of variable volume, the compression chambers having a volume which gradually decreases from the outside, where the refrigerant fluid is admitted towards the inside.

Thus, during the orbital movement of the first volute, the refrigerant fluid is compressed because of the decrease in the volume of the compression chambers and is conveyed up to the center of the first and second volutes. The compressed refrigerant fluid flows out in the central portion towards a delivery chamber via a delivery line made in the central portion of the first volute.

In order to improve the performances of such a compressor depending on the seasons, and more particularly depending on cold demand, it is known how to make compressors with a variable capacity and/or with variable compression rate.

Document U.S. Pat. No. 5,855,475 describes a scroll refrigeration compressor with a variable compression rate comprising orifices for letting through refrigerant fluid, made in the plate of the stationary volute and each opening into one of the compression chambers and into the delivery chamber, respectively on the one hand and bypass valves positioned on the surface of the plate of the stationary volute turned towards the side opposite to the scrolls and each moveable between an open position allowing delivery of refrigerant fluid from the corresponding compression chamber to the delivery chamber, and a closing position preventing the delivery of refrigerant fluid from the corresponding compression chamber to the delivery chamber, on the other hand.

When one of the bypass valves is subject, on its face turned towards the plate of the stationary volute, to a pressure below the pressure in the delivery chamber, said valve is maintained in its closing position and isolates the corresponding compression chamber from the delivery chamber. The result of this is that the compression rate of the compressor is maintained at its maximum value.

When one of the bypass valves is subject, on its face turned towards the plate of the stationary volute, to a pressure above the pressure in the delivery chamber, said valve elastically deforms towards its opening position and puts the corresponding compression chamber in communication with the delivery chamber. Thus the result thereof is delivery towards the delivery chamber of a portion of the compressed refrigerant fluid in the compression chambers into which open passage orifices before this portion of the refrigerant fluid reaches as far as the center of the scrolls.

The presence of such passage orifices and of such bypass valves gives the possibility of reducing, depending on the seasons, the compression rate of each compression chamber, and consequently avoiding overcompression of the refrigerant fluid. With these provisions, it is thereby possible to improve the energy efficiency of the compressor.

The presence of such passage orifices and of such bypass valves also gives the possibility of reducing the mechanical forces exerted on the volute and the shaft for driving the moving volute, and therefore increasing the reliability of the compressor.

However, the installation of such bypass valves on the upper surface of the stationary volute of a compressor may prove to be difficult, or even impossible, notably when access to the upper portion of the stationary volute is hindered by the existence of a high pressure/low pressure separation bell covering the stationary volute or by the presence of sealing elements at the delivery line.

The present invention aims at finding a remedy to these drawbacks.

The technical problem at the base of the invention therefore consists of providing a valve arrangement for a scroll refrigeration compressor which is of a simple and economical structure, while allowing simple and easy mounting of the valve arrangement on one of the volutes of the compressor.

For this purpose, the invention relates to a valve arrangement for a scroll refrigeration compressor, comprising:

- a valve plate intended to be mounted on the plate of a volute of the compressor, the valve plate comprising a first face and a second face opposite to the first face, at least one delivery port intended to allow flow of fluid from a delivery line made in said volute, and a valve seat made on the first face of the valve plate and surrounding the delivery port,
- a moveable delivery valve between an obturation position in which the delivery valve bears against the valve seat and obturates the delivery port, and a release position in which the delivery valve is moved away from the valve seat and clears the delivery port,
- retaining means arranged for limiting the movement range of the delivery valve towards its release position, characterized in that it further comprises:
- at least one bypass valve positioned adjacent to the second face of the valve plate, the bypass valve being moveable between an obturation position in which it is intended to obturate a bypass channel made in the plate of said volute, and a release position in which it is intended to clear said bypass channel,
- retaining means positioned on the second face of the valve plate and arranged for limiting the movement range of the bypass valve towards its release position.

Such an arrangement is compact and may therefore easily be mounted on the stationary volute of a compressor at the delivery line made in the central portion of the latter.

Consequently, the mounting of the valve arrangement, which includes one or several bypass valves, is by no means hindered by the presence of a possible high pressure/low pressure separation bell covering the stationary volute or of sealing elements around the delivery line.

According to an embodiment of the invention, said or each bypass valve is made as an elastically deformable strip between an obturation position and a release position.

Preferably, the valve arrangement comprises a valve-holder plate positioned adjacent to the second face of the valve plate, the valve-holder plate comprising at least one bypass valve made with said valve-holder plate in the same material and made as an elastically deformable strip between an obturation position and a release position.

Advantageously, the valve-holder plate, the valve holder and the means for retaining the delivery valve are assembled to each other and formed with the delivery valve, a sub-assembly intended to be mounted on the plate of said volute. With these provisions, it is possible to facilitate the mounting of the arrangement on the volute of the compressor.

Preferentially, the valve-holder plate comprises a plurality of bypass valves.

According to an embodiment, the valve-holder plate has a substantially ring or disc shape, and the bypass valves are distributed around the center of the valve-holder plate.

Preferably, the bypass valves are regularly distributed around the center of the valve-holder plate. Advantageously, each bypass valve substantially extends as a circular arc.

Advantageously, the valve plate comprises on its second face, at least one recess, the bottom of which forms the retaining rings of the bypass valve.

The retaining rings of the delivery valve advantageously include a retaining plate mounted on the first face of the valve plate.

The present invention also relates to a scroll refrigeration compressor comprising:

- a stationary volute and a moving volute describing an orbital movement, each volute including a plate from which a scroll extends, the scrolls of the stationary and moving volutes being engaged into each other and delimiting variable-volume compression chambers,
- a delivery line, made in the central portion of the plate of the stationary volute, comprising a first end opening into a central compression chamber and a second end intended to be put into communication with a delivery chamber made in the compressor,
- a valve arrangement according to the invention mounted on the plate of the stationary volute of the compressor, at the second end of the delivery line, and
- at least one bypass passage comprising a first end opening into an intermediate compression chamber or into a low pressure portion of the compressor, and a second end opening into the surface of the plate of the stationary volute turned towards the side of the valve plate, facing the bypass valve Preferably, the compressor comprises a separation plate mounted on the plate of the stationary volute so as to surround the delivery line and the valve arrangement, the separation plate delimiting at least partly the delivery chamber.

Anyway, the invention will be well understood by means of the description which follows with reference to the appended schematic drawing illustrating as non-limiting examples, several embodiments of this valve arrangement.

In the description which follows, the same elements are designated with the same references in the different embodiments.

Figure 1:
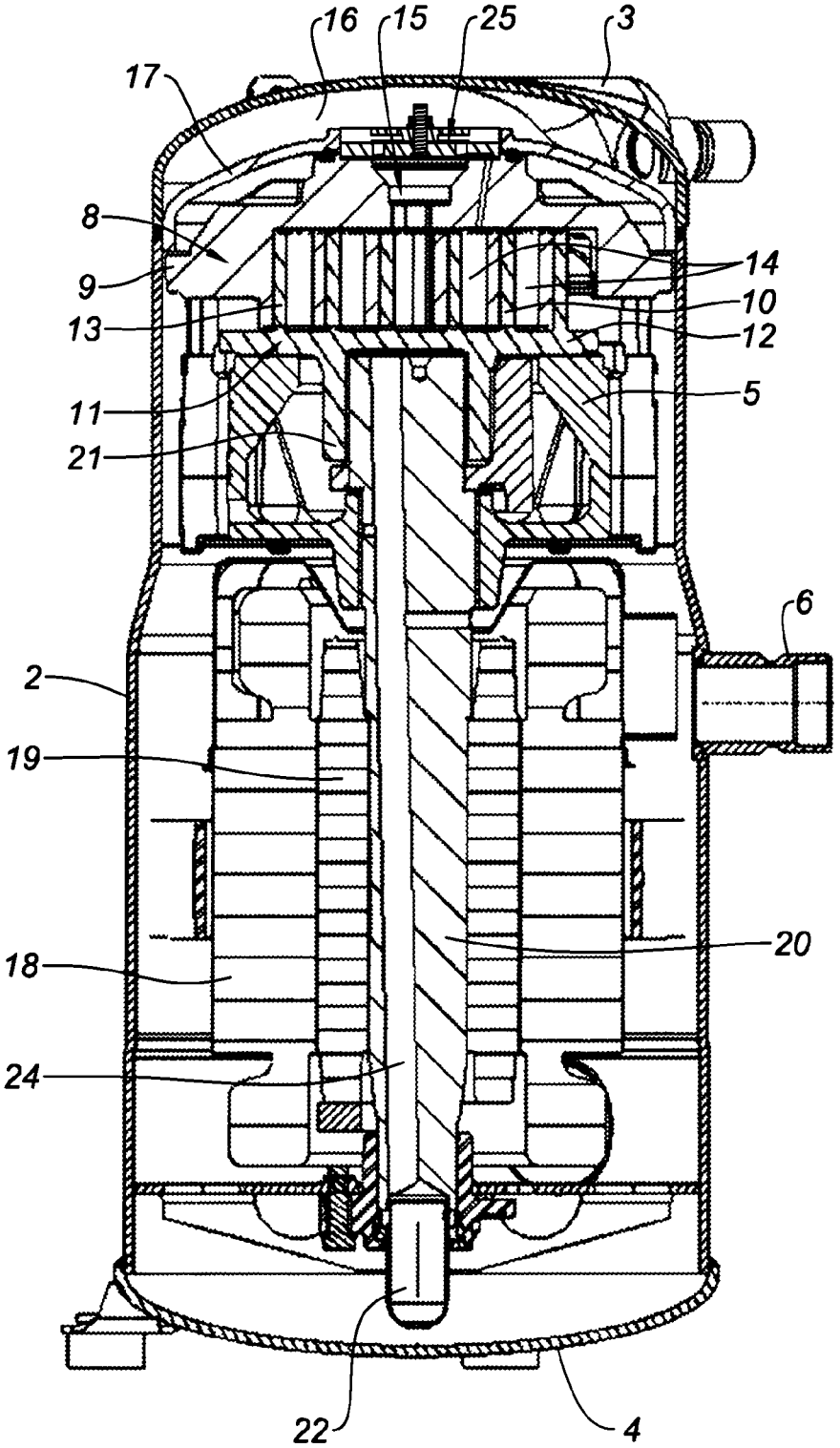
FIG. 1 is a longitudinal sectional view of a compressor according to a first embodiment of the invention.

FIG. 1 describes a scroll refrigeration compressor occupying a vertical position, however the compressor according to the invention, may occupy a tilted position or a horizontal position, without its structure being modified significantly.

The compressor illustrated in FIG. 1 comprises a sealed enclosure delimited by a ferrule 2, the upper and lower ends of which are respectively closed by a lid 3 and a base 4. The assembling of this enclosure may be achieved notably by means of welding beads.

The intermediate portion of the compressor is occupied by a body 5 which delimits two volumes, a suction volume located below the body 5, and a compression volume positioned above the latter. The ferrule 2 comprises a refrigerant gas inlet 6, opening into the suction volume for achieving supply of gas to the compressor.

The body 5 is used for mounting a stage 7 for compressing the refrigerant gas. This compression stage 7 comprises a stationary volute 8 including a plate 9 from which extends a stationary scroll 10 turned downwards, and a moving volute 11 including a plate 12 bearing against the body and from which extends a scroll 13 turned upwards. Both scrolls 10 and 13 of both volutes penetrate into each other in order to make variable-volume compression chambers 14.

The compressor further comprises a delivery line 15 made in the central portion of the stationary volute 8. The delivery line 15 comprises a first end opening into the central compression chamber and a second end intended to be put into communication with a high pressure delivery chamber 16, made in the enclosure of the compressor. The delivery chamber 16 is partly delimited by a separation plate 17 mounted on the plate 9 of the stationary volute 8 so as to surround the delivery line 15.

The compressor comprises a three-phase electric motor positioned in the suction volume. The electric motor comprises a stator 18 at the center of which is positioned a rotor 19.

The rotor 19 is firmly attached to a driving shaft 20, the upper end of which is off-axis like a crankshaft. This upper portion is engaged into a sleeve-shaped portion 21 which the moving volute 11 includes. During its driving into rotation by the motor, the driving shaft 20 drives the moving volute 11 according to an orbital movement.

The lower end of the driving shaft 20 drives an oil pump 22 feeding, from oil contained in a case delimited by the base 4, a supply line with oil 24, made in the central portion of the driving shaft, the supply line 24 being off-axis and extending over the whole length of the driving shaft 20.

Figure 2:
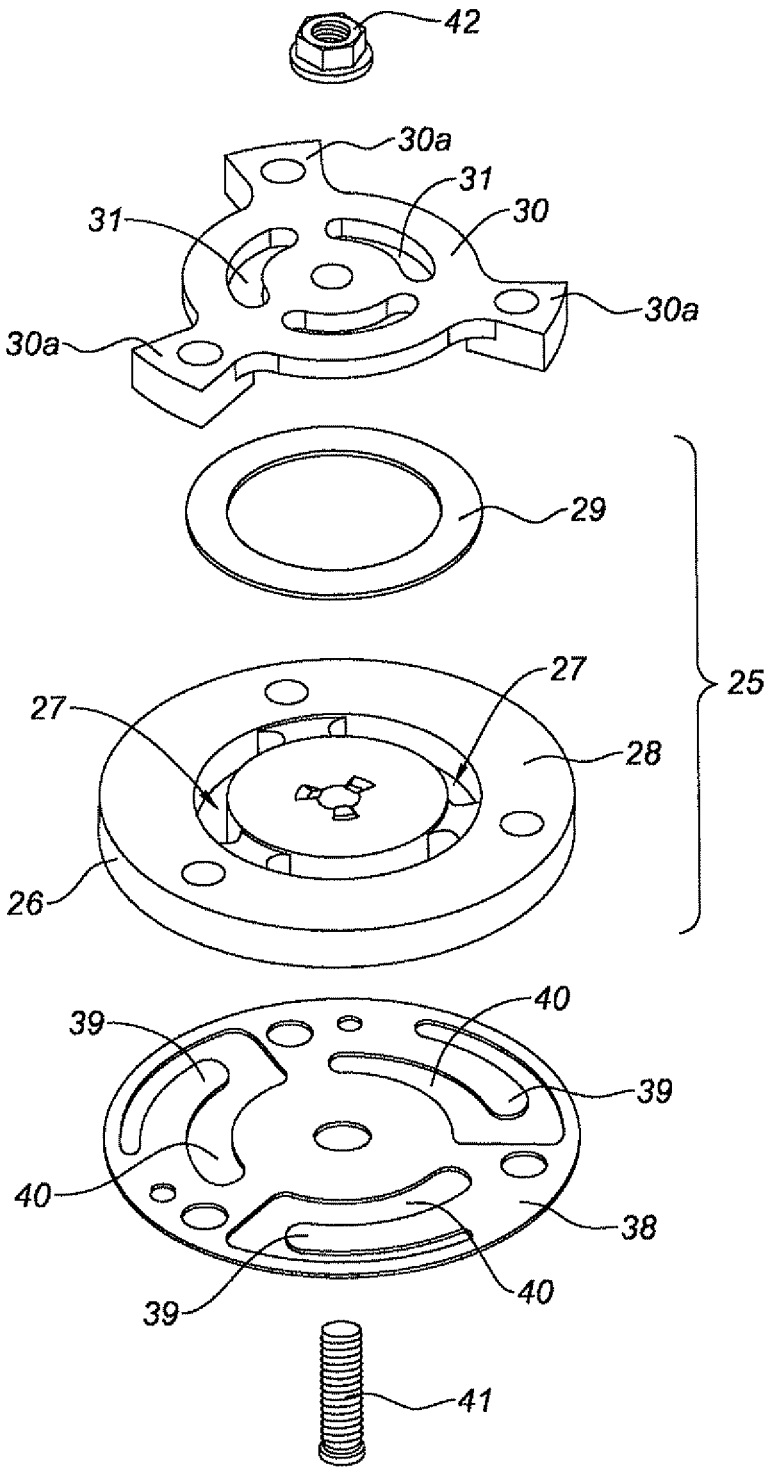
FIG. 2 is an exploded view as a perspective from the top, of a valve arrangement of the compressor of FIG. 1.
Figure 3:
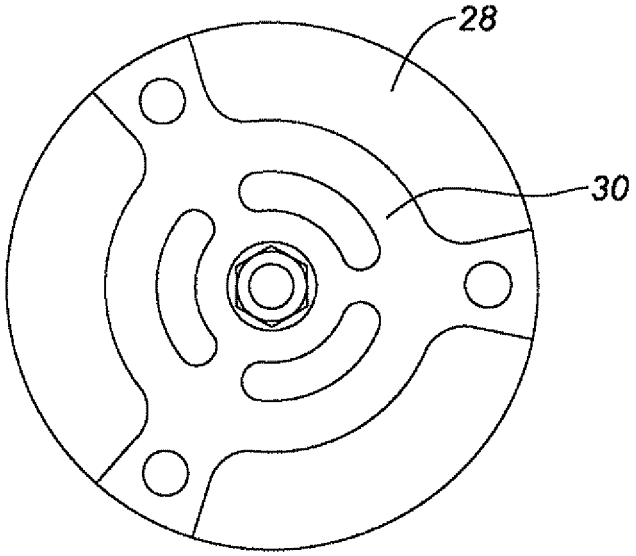
FIG. 3 is a top view of the valve arrangement of FIG. 2.
Figure 4:
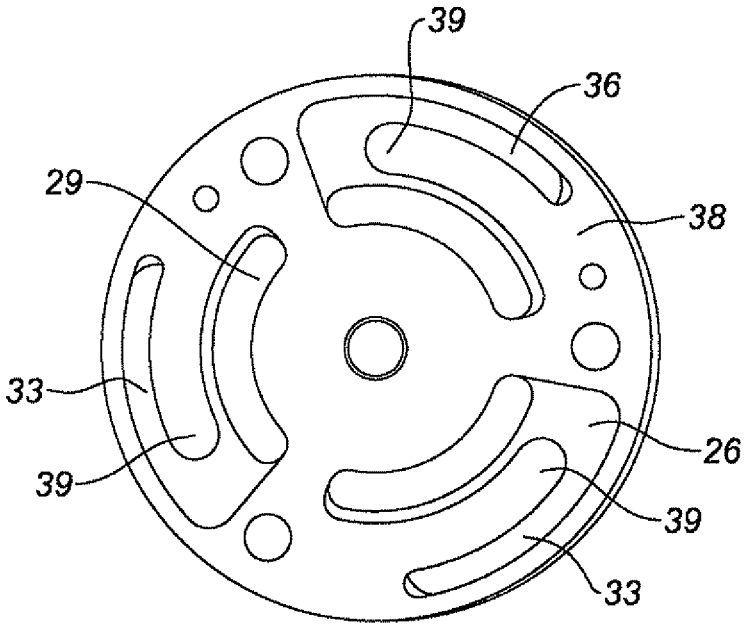
FIG. 4 is a bottom view of the valve arrangement of FIG. 2.
Figure 6:
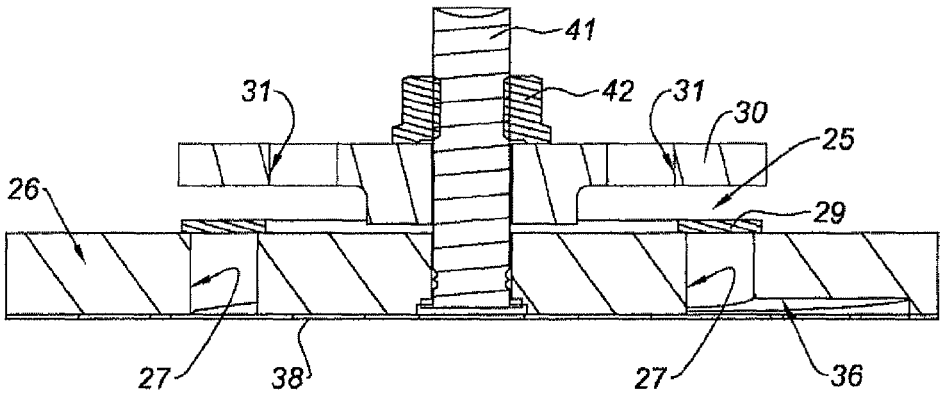
FIG. 6 is a sectional view of the valve arrangement of FIG. 2.
Figure 7:
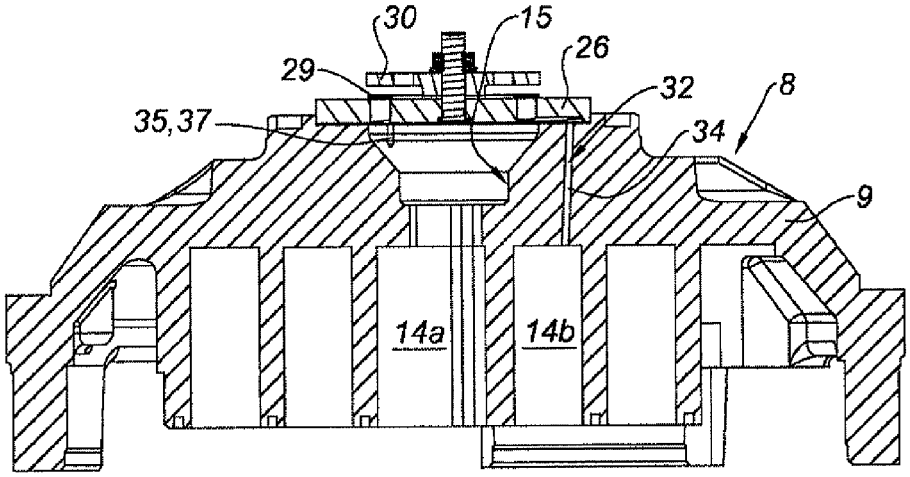
FIG. 7 is a sectional view of the stationary volute of the compressor of FIG. 1 equipped with the valve arrangement of FIG. 2.

As shown more particularly in FIGS. 2 and 6, the compressor comprises an anti-return device 25. The anti-return device 25 includes a valve plate 26 in the form of a disc mounted on the plate 9 of the stationary volute 8 at the second end of the delivery line 15. The valve plate 26 comprises a plurality of delivery ports 27 arranged so as to put the delivery line 15 and the delivery chamber 16 into communication, and a valve seat 28 made on the surface of the valve plate 26 opposite to the stationary volute 8 and surrounding the delivery ports 27. The delivery ports 27 have the shape of a bean but may have another shape for example a cylindrical shape.

The anti-return device 25 also includes a delivery valve 29 moveable between an obturation position in which the delivery valve 29 bears against the valve seat 28 and obturates the delivery ports 27, and a release position in which the delivery valve 29 is away from the valve seat 28 and clears the delivery ports 27. The delivery valve 29 is designed so as to be displaced in its release position when the pressure in the delivery line 15 exceeds the pressure in the delivery chamber 16 by a first predetermined value substantially corresponding to the adjustment pressure of the delivery valve 29. The delivery valve 29 is for example substantially ring-shaped.

The compressor also comprises a retaining plate 30 mounted on the valve plate 26 and intended to be used as an abutment for the delivery valve 29 when it is in its release position. The retaining plate 30 comprises three supporting portions 30*a* intended to rest on the valve plate 26 and at least one passage orifice 31 arranged so as to allow flow of refrigerant fluid from the delivery ports 27 to the delivery chamber 16. The retaining plate 30 may comprise one or several passage orifices 31, and each passage orifice 31 may have for example a bean shape or a cylindrical shape.

Figure 5:
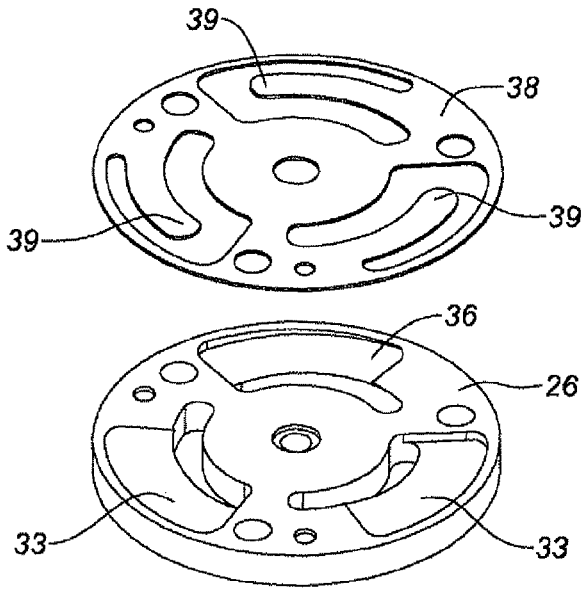
FIG. 5 is an exploded partial view as a perspective from below, of the valve arrangement of FIG. 2.

The compressor further comprises two bypass passages 32 (a single bypass passage 32 is visible in the figures). Each bypass passage 32 is formed with a bypass recess 33 (more particularly shown in FIG. 5) made in the surface of the valve plate 26 turned towards the side of the plate 9 of the stationary volute 8, and opening into the delivery line 15 on the one hand and with a bypass channel 34 made in the plate 9 of the stationary volute and comprising a first end opening into an intermediate compression chamber 14 and a second end opening into the surface of the plate 9 of the stationary volute 8 turned towards the side of the valve plate 26, facing the corresponding bypass recess 33, on the other hand.

The compressor further comprises a bypass passage 35 formed with a bypass recess 36 made in the surface of the valve plate 26 turned towards the side of the plate 9 of the stationary volute 8, and opening into the delivery line 15 on the one hand, and with a bypass channel 37 made in the plate 9 of the stationary volute and comprising a first end opening into a low pressure portion of the compressor and a second end opening into the surface of the plate 9 of the stationary volute 8 turned towards the side of the valve plate 26, facing the bypass recess 36 on the other hand.

Preferably, the bypass recesses 33, 36 are identical and are respectively made in the valve plate 26 at a location further away from the center of the latter than the delivery ports 27.

The compressor further comprises a valve-holder plate 38 positioned between the valve plate 26 of the anti-return device 25 and the plate 9 of the stationary volute 8. The valve-holder plate 38 substantially has a disc shape.

The valve-holder plate 38 comprises three bypass valves 39 made with said valve-holder plate 38 and in the same material and each made as an elastically deformable strip between a position for obturating the first end of the corresponding bypass channel and a position for clearing said first end. The bypass valves 39 are preferably regularly distributed around the center of the valve-holder plate 38 and for example extend substantially as a circular arc.

Each bypass valve 39 is designed so as to be displaced into its release position when the pressure in the low pressure portion of the compressor or the intermediate compression chamber into which opens the corresponding bypass passage, exceeds the pressure in the delivery line 15 by a second predetermined value substantially corresponding to the adjustment pressure of said bypass valve 39.

It should be noted that the bottom of each bypass recess made in the valve plate 26 advantageously forms an abutment surface arranged for limiting the movement range of the associated bypass valve 39 towards its release position.

The valve-holder plate 38 further comprises at least one passage orifice 40 arranged for allowing refrigerant fluid flow from the delivery line 15 to the delivery ports 27. The valve-holder plate 38 may comprise one or several passage orifices 40 and each passage orifice 40 may for example have a bean shape or cylindrical shape.

Advantageously, the valve-holder plate 38, the valve plate 26 and the retaining plate 30 are secured to each other via a screw 41 crossing orifices made in the central portions of the latter and a nut 42. Thus, these three plates and the delivery valve 29 form a preassembled compact valve arrangement which may easily be mounted on the plate 9 of the stationary volute 8. This valve arrangement may be mounted on the plate of the stationary volute 8 for example by means of three fixing screws crossing orifices made in the three plates and screwed into tapped holes made in the plate 9 of the stationary volute 8.

The operation of the scroll compressor will now be described.

When the scroll compressor according to the invention is started, the moving volute 11 is driven by the driving shaft 20 along an orbital movement, this movement of the moving volute causing admission and compression of refrigerant fluid in the variable-volume compression chambers 14.

Under optimum operating conditions, each bypass valve 39 intended to obturate a bypass passage 32 opening into one of the compression chambers 14 is subject, on its face turned towards the plate 9 of the stationary volute 8, to a pressure below the pressure in the delivery line 15. Thus, said bypass valves 39 are maintained in their obturation position and therefore isolate the compression chambers 14 into which open the corresponding bypass passages 32.

Consequently, the totality of the compressed refrigerant fluid in the compression chambers 14 reaches as far as the center of the scrolls and escapes through the delivery line 15 towards the delivery chamber 16 by flowing through the passage orifices 40 and the delivery ports 27, and then by displacing the delivery valve 29 into its release position, and finally by axially flowing through the passage orifices 31 and radially through the spaces delimited between the attachment portions 30*a*.

Accordingly, under optimum operating conditions, the <<design>> compression rate of the compressor corresponds to the compression rate imposed by the operating conditions, and therefore the <<actual>> compression rate of the compressor is maintained at its maximum value.

Under operating conditions imposing a lower compression rate than the <<design>> compression rate of the compressor, such as for example in mid-season, each bypass valve 39 intended to obturate a bypass passage 32 opening into one of the compression chambers 14 may be subject, on its face turned towards the plate 9 of the stationary volute 8, to a pressure above the pressure in the delivery line 15. In this scenario, said bypass valves 39 elastically deform towards their release position and put the compression chambers 14 in communication, into which open the corresponding bypass passages 32, with the delivery line 15 made in the stationary volute 8. Thus, the result thereof is delivery towards the delivery line 15 of a portion of the refrigerant fluid compressed in the compression chambers 14 into which open the bypass channels 33 before this portion of the refrigerant fluid reaches as far as the center of the scrolls.

With these arrangements, it is possible to reduce the compression rate of each compression chamber, and therefore of the compressor. Overcompression of the refrigerant fluid is thus avoided, which allows an improvement in the energy efficiency of the compressor and limitation of the wear of the latter.

In the case of a connection fault of the power supply wires of the electric motor causing inversion of the direction of rotation of the driving shaft 20 of the moving volute and generation of a negative pressure at the center of the scrolls 10, 13, the bypass valve 39 intended to obturate the bypass passage 35 opening into the low pressure portion of the compressor is subject, on its face turned towards the plate 9 of the stationary volute 8, to a pressure above the pressure in the delivery line 15. Thus, said bypass valve 39 elastically deforms towards its release position and puts the low pressure portion of the compressor in communication with the delivery line 15. These arrangements avoid that the stationary and moving volutes be brought closer to each other, and therefore overheating of the latter which may cause degradation of the compressor if the connection fault is not detected sufficiently early.

Figure 8:
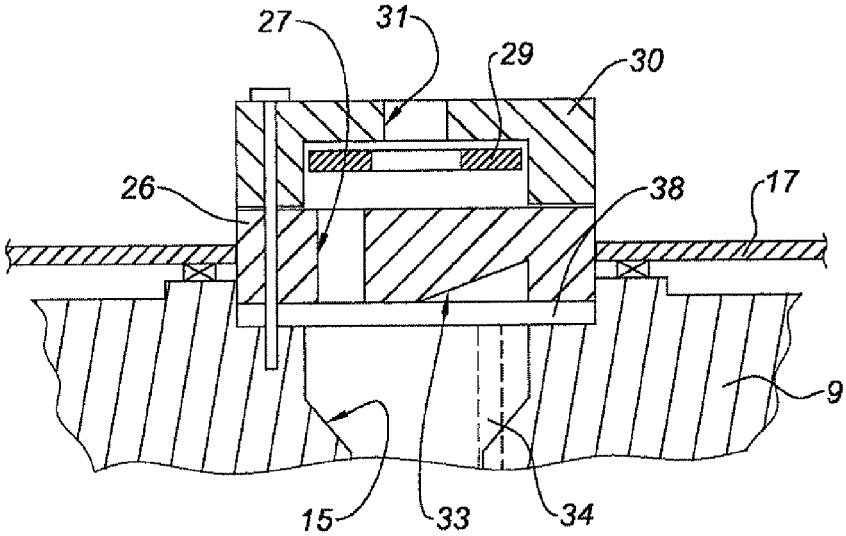
FIG. 8 is a partial sectional view of a compressor according to a second embodiment of the invention.
Figure 9:
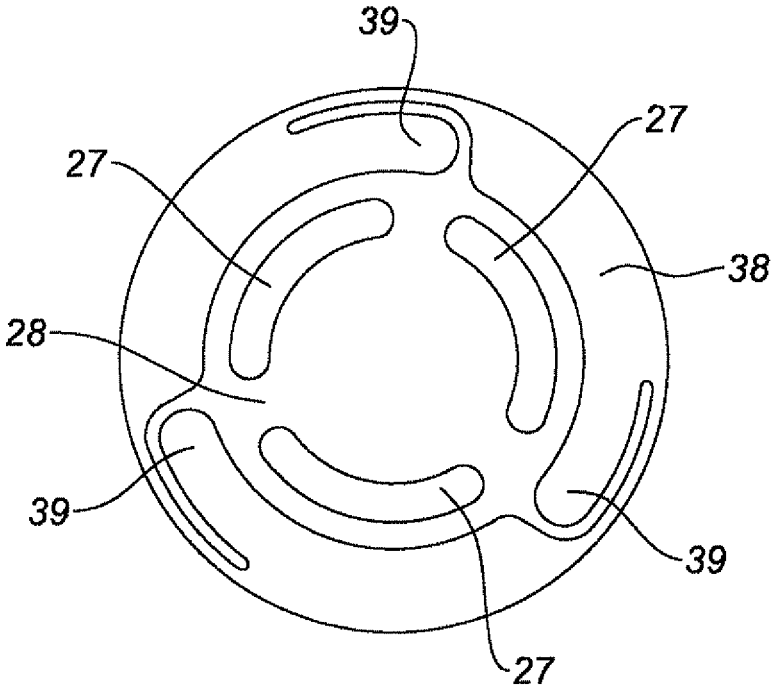
FIG. 9 is a top view of the valve arrangement of the compressor of FIG. 8.

FIGS. 8 and 9 illustrate a second embodiment of the invention which differs from the one shown in FIGS. 1 to 7 and in that the valve-holder plate 38 is substantially ring-shaped, and in that the retaining plate 30 only includes a single passage orifice 31.

As this is obvious, the invention is not limited to the sole embodiments of this valve arrangement, described above as examples, on the other hand, it encompasses all the alternative embodiments thereof.

The invention claimed is:

1. A scroll refrigeration compressor comprising:

a stationary volute and a moving volute describing an orbital movement, each volute including a plate from which extends a scroll, the scrolls of the stationary and moving volutes being engaged into each other and delimiting variable-volume compression chambers, a delivery line, made in the central portion of the plate of the stationary volute, comprising a first end opening into a central compression chamber and a second end intended to be put into communication with a delivery chamber made in the compressor, a valve arrangement mounted on the plate of the stationary volute, at the second end of the delivery line, and at least one bypass channel comprising a first end opening into an intermediate compression chamber or into a low pressure portion of the compressor, and a second end opening into the surface of the plate of the stationary volute turned towards the side of the valve plate, facing the bypass valve, wherein the valve arrangement comprises:

a valve plate configured to be mounted on a plate of a volute of the compressor, the valve plate comprising a first face and a second face opposite to the first face, at least one delivery port configured to allow fluid flow from a delivery line made in said volute, and a valve seat made on the first face of the valve plate and surrounding the delivery port, a delivery valve moveable between an obturation position in which the delivery valve bears against the valve seat and obturates the delivery port and a release position in which the delivery valve is away from the valve seat and clears the delivery port, a retaining plate configured to limit the movement range of the delivery valve towards its release position, at least one bypass valve positioned adjacent to the second face of the valve plate, the bypass valve being moveable between an obturation position in which the bypass valve is configured to obturate a bypass channel made in the plate of said volute, and a release position in which the bypass valve is configured to clear said bypass channel, and at least one recess provided on the second face of the valve plate and configured to limit the movement range of the bypass valve towards its release position.

2. The scroll refrigeration compressor according to claim 1, wherein said or each bypass valve is made as a strip elastically deformable between an obturation position and a release position.

3. The scroll refrigeration compressor according to claim 1, further comprising a valve-holder plate positioned adjacent to the second face of the valve plate, the valve-holder plate comprising at least one bypass valve made with said valve-holder plate in the same material and made as a strip elastically deformable between an obturation position and a release position.

4. The scroll refrigeration compressor according to claim 3, wherein the valve-holder plate, the valve plate and the retaining plate are assembled together and form with the delivery valve, a sub-assembly configured to be mounted on the plate of said volute.

5. The scroll refrigeration compressor according to claim 3, wherein the valve-holder plate comprises a plurality of bypass valves.

6. The scroll refrigeration compressor according to claim 5, wherein the valve-holder plate has a substantially ring or disc shape, and the bypass valves are distributed around the center of the valve-holder plate.

7. The scroll refrigeration compressor according to claim 1, wherein the bottom of the at least one recess is configured to limit the movement range of the bypass valve towards its release position.

8. The scroll refrigeration compressor according to claim 1, wherein the retaining plate is mounted on the first face of the valve plate.

9. The scroll refrigeration compressor according to claim 1, further comprising a separation plate mounted on the plate of the stationary volute so as to surround the delivery line and the valve arrangement, the separation plate delimiting at least partly the delivery chamber.

10. A scroll refrigeration compressor, comprising:

a stationary volute and a moving volute describing an orbital movement, each volute including a plate from which extends a scroll, the scrolls of the stationary and moving volutes being engaged into each other and delimiting variable-volume compression chambers, a delivery line, made in the central portion of the plate of the stationary volute, comprising a first end opening into a central compression chamber and a second end intended to be put into communication with a delivery chamber made in the compressor, a valve arrangement mounted on the plate of the stationary volute, at the second end of the delivery line, and at least one bypass channel comprising a first end opening into an intermediate compression chamber or into a low pressure portion of the compressor, and a second end opening into the surface of the plate of the stationary volute turned towards the side of the valve plate, facing the bypass valve, wherein the valve arrangement comprises:

a valve plate configured to be mounted on a plate of a volute of the compressor, the valve plate comprising a first face and a second face opposite to the first face, at least one delivery port configured to allow fluid flow from a delivery line made in said volute, and a valve seat made on the first face of the valve plate and surrounding the delivery port, a delivery valve moveable between an obturation position in which the delivery valve bears against the valve seat and obturates the delivery port and a release position in which the delivery valve is away from the valve seat and clears the delivery port, a retaining plate mounted on the first face of the valve plate and configured to limit the movement range of the delivery valve towards its release position, and at least one bypass valve positioned adjacent to the second face of the valve plate, the at least one bypass valve being moveable between an obturation position in which the at least one bypass valve is configured to obturate a bypass channel made in the plate of said volute, and a release position in which the at least one bypass valve is configured to clear said bypass channel, wherein the valve plate further comprises, on its second face, at least one recess, the bottom of the at least one recess being configured to limit the movement range of the at least one bypass valve towards its release position.

* * * * *